US010077939B2

(12) United States Patent
Valero Navazo et al.

(10) Patent No.: US 10,077,939 B2
(45) Date of Patent: Sep. 18, 2018

(54) TO DIRECT AIR TO MEDIA

(71) Applicant: Hewlett-Packard Development Company, L.P., Houston, TX (US)

(72) Inventors: Juan Manuel Valero Navazo, Barcelona (ES); Francisco Javier Pérez Gellida, Barcelona (ES); Emilio Angulo Navarro, Barcelona (ES); Antonio Monclus Velasco, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 852 days.

(21) Appl. No.: 13/752,201

(22) Filed: Jan. 28, 2013

(65) Prior Publication Data

US 2014/0208607 A1 Jul. 31, 2014

(51) Int. Cl.
*F26B 21/12* (2006.01)
*F26B 21/00* (2006.01)

(52) U.S. Cl.
CPC ..... *F26B 21/12* (2013.01); *F26B 21/004* (2013.01)

(58) Field of Classification Search
CPC ..... F26B 21/004; F26B 21/12; B05C 5/00
See application file for complete search history.

(56) References Cited

U.S. PATENT DOCUMENTS 3,771,239 A * 11/1973 Minoda et al. ..... 34/640
3,895,449 A * 7/1975 Chance et al. ..... 34/638
5,201,132 A * 4/1993 Jacob ..... F26B 21/004 34/393
5,941,520 A 8/1999 Stephan et al.
6,463,674 B1 10/2002 Meyers et al.
7,185,966 B2 * 3/2007 Kamiyama ..... G01V 8/12 347/19
8,602,529 B2 * 12/2013 Kamiyama ..... 347/47
8,851,655 B2 * 10/2014 Velasco ..... B41J 11/001 347/101
2004/0098839 A1 * 5/2004 Brenek ..... A61K 9/14 23/295 R
2005/0160621 A1 * 7/2005 Hartmann ..... 34/629
2005/0217523 A1 10/2005 Hachmann et al.
2005/0253912 A1 * 11/2005 Smith ..... B41J 2/04553 347/102
2007/0199206 A1 8/2007 Park et al.
2014/0023791 A1 * 1/2014 Peleg et al. ..... 427/428.01

FOREIGN PATENT DOCUMENTS

DE 102009033492 A1 1/2011

OTHER PUBLICATIONS

"Hot-Air Drying System", Sep. 28, 2012. <http://www.duo-technik.de/products/drying-systems/drying-system.html?L=1 >.

* cited by examiner

*Primary Examiner* — Jessica Yuen
(74) *Attorney, Agent, or Firm* — HP Inc. Patent Department

(57) ABSTRACT

Apparatus for directing air to media. The apparatus including an impinging plate having an array of orifices. The orifices are arranged in a plurality of rows oblique to the direction of motion of the media, and are also arranged to provide air to the media.

19 Claims, 5 Drawing Sheets

TO DIRECT AIR TO MEDIA

BACKGROUND

Printing systems usually include an applicator for applying liquid to media. For example, a printing system may include a printer that is arranged to provide ink to paper. The applied liquid may require a certain amount of time to dry or cure which may limit the printing systems throughput or may result in the liquid being smeared on the media.

BRIEF DESCRIPTION OF DRAWINGS

Reference will now be made by way of example only to the accompanying drawings in which.

DETAILED DESCRIPTION

Figure 1:
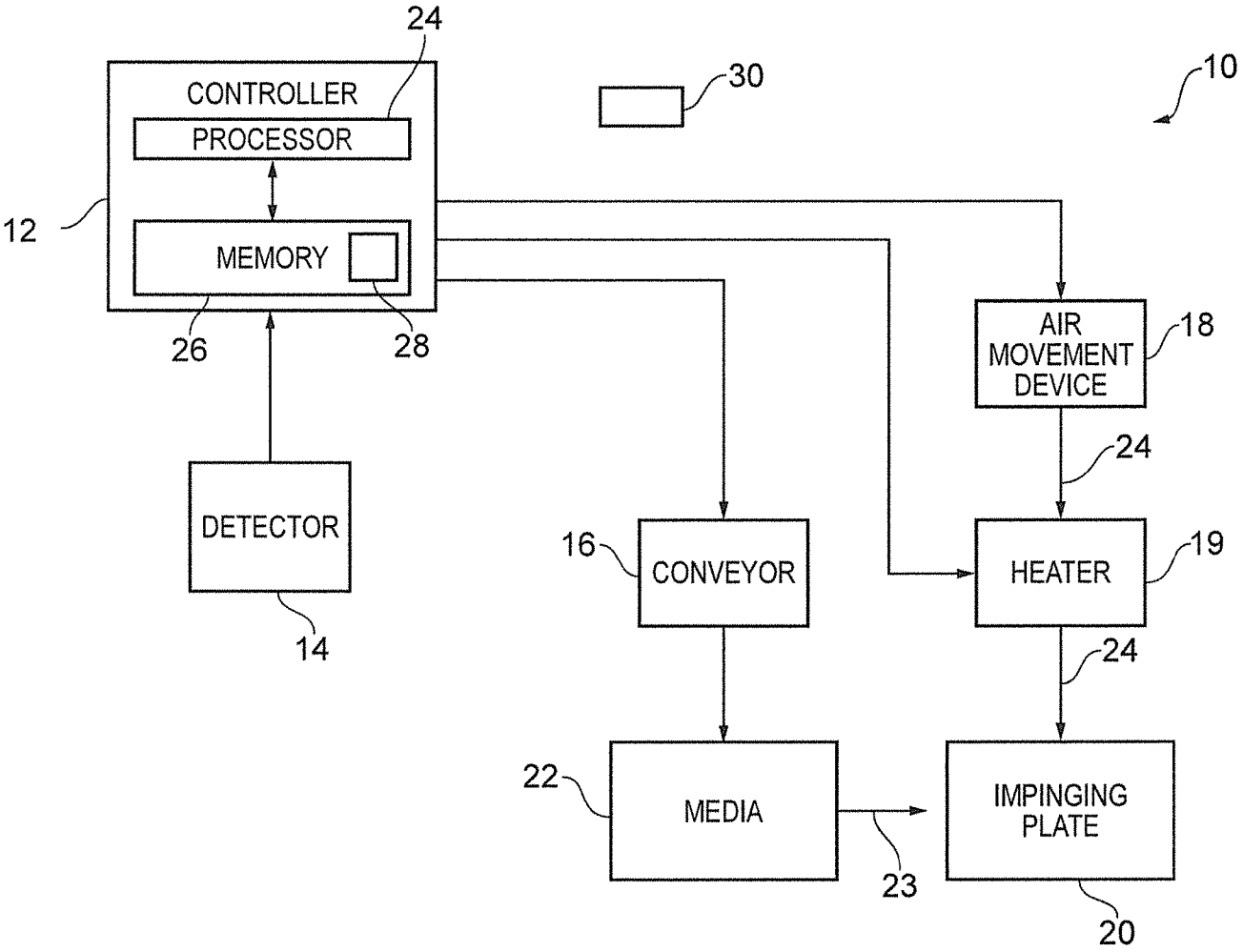
FIG. 1 illustrates a schematic diagram of an apparatus to direct air to media according to an example.

FIG. 1 illustrates a schematic diagram of an apparatus 10 including a controller 12, a detector 14, a conveyor 16, an air movement device 18, a heater 19 and an impinging plate 20. The apparatus 10 is arranged to direct air to media 22 to dry or cure liquid applied to the media 22.

The apparatus 10 may be a module. As used here, 'module' refers to a unit or apparatus that excludes certain parts/components that would be added by an end manufacturer or a user. For example, the apparatus 10 may only include the impinging plate 20 and the other components described above (such as the controller 12) may be added by an end manufacturer.

The implementation of the controller 12 can be in hardware alone (for example, a circuit, a processor and so on), have certain aspects in software including firmware alone or can be a combination of hardware and software (including firmware).

The controller 12 may be implemented using instructions that enable hardware functionality, for example, by using executable computer program instructions in a general-purpose or special-purpose processor 24 that may be stored on a computer readable storage medium 26 (disk, memory and so on) to be executed by such a processor 24.

The processor 24 is configured to read from and write to the memory 26. The processor 24 may also comprise an output interface via which data and/or commands are output by the processor 24 and an input interface via which data and/or commands are input to the processor 24.

The memory 26 stores a computer program 28 comprising computer program instructions that control the operation of the apparatus 10 when loaded into the processor 24. The computer program instructions 28 provide the logic and routines that enables the apparatus 10 to perform the method illustrated in FIG. 4. The processor 24 by reading the memory 26 is able to load and execute the computer program 28.

The computer program 28 may arrive at the apparatus 10 via any suitable delivery mechanism 30. The delivery mechanism 30 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 28. The delivery mechanism 30 may be a signal configured to reliably transfer the computer program 28. The apparatus 10 may propagate or transmit the computer program 28 as a computer data signal.

Although the memory 26 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device and so on.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware.

The detector 14 is arranged to detect the presence of media 22 at the apparatus 10 and provide a signal to the controller 12 indicating that media 22 is present. For example, the detector 14 may include an optical sensor that is arranged to determine the presence of media 22 by detecting a reduction in light received at the optical sensor due to the presence of the media 22 in the light path.

The conveyor 16 is arranged to move the media 22 through the apparatus 10 (as indicated by arrow 23). The conveyor 16 may include any suitable device for conveying the media 22 and may include rollers and/or a conveyor belt. The controller 12 is arranged to control the operation of the conveyor 16. For example, the controller 12 may control the operation of the conveyor 16 in response to: receiving a signal from the detector 14; the powering on of the apparatus 10; or an input from a user input device (not illustrated in this figure), to move the media 22 through the apparatus 10.

The air movement device 18 is arranged to provide air 24 to the impinging plate 20 via the heater 19 and may be any suitable air movement device. For example, the air movement device 18 may include at least one fan and/or at least one pump. The controller 12 is arranged to control the operation of the air movement device 18 to provide air 24 to the impinging plate 20. For example, the controller 12 may be arranged to control the operation of the air movement device 18 in response to: receiving a signal from the detector 14; the powering on of the apparatus 10; or an input from a user input device, to provide air 24 to the impinging plate 20.

The heater 19 is positioned between the air movement device 18 and the impinging plate 20 and is arranged to receive air 24 from the air movement device 18 and heat the air 24 so that the impinging plate 20 provides heated air to the media 22. In other examples, the air movement device 18 may be positioned between the heater 19 and the impinging plate 20. The controller 12 is arranged to control the operation of the heater 19. For example, the controller 12 may be arranged to control the operation of the heater 19 in response to: receiving a signal from the detector 14; the powering on of the apparatus 10; or an input from a user input device, to heat the air 24.

The impinging plate 20 is arranged to receive the air 24 from the air movement device 18 (via a conduit for example) and provide the air 24 to the media 22 to dry or cure liquid on the media 22. The structure of the impinging plate 20 is described in greater detail in the following paragraphs with reference to FIGS. 2 and 5.

The media 22 may be a sheet or a web of media. The media 22 may comprise any suitable materials for receiving a liquid such as primer, ink or varnish. For example, the media 22 may comprise cellulose fibers (such as paper) and/or polymer fibers (such as polyvinyl chloride (PVC) or polypropylene (PP)).

Figure 2:
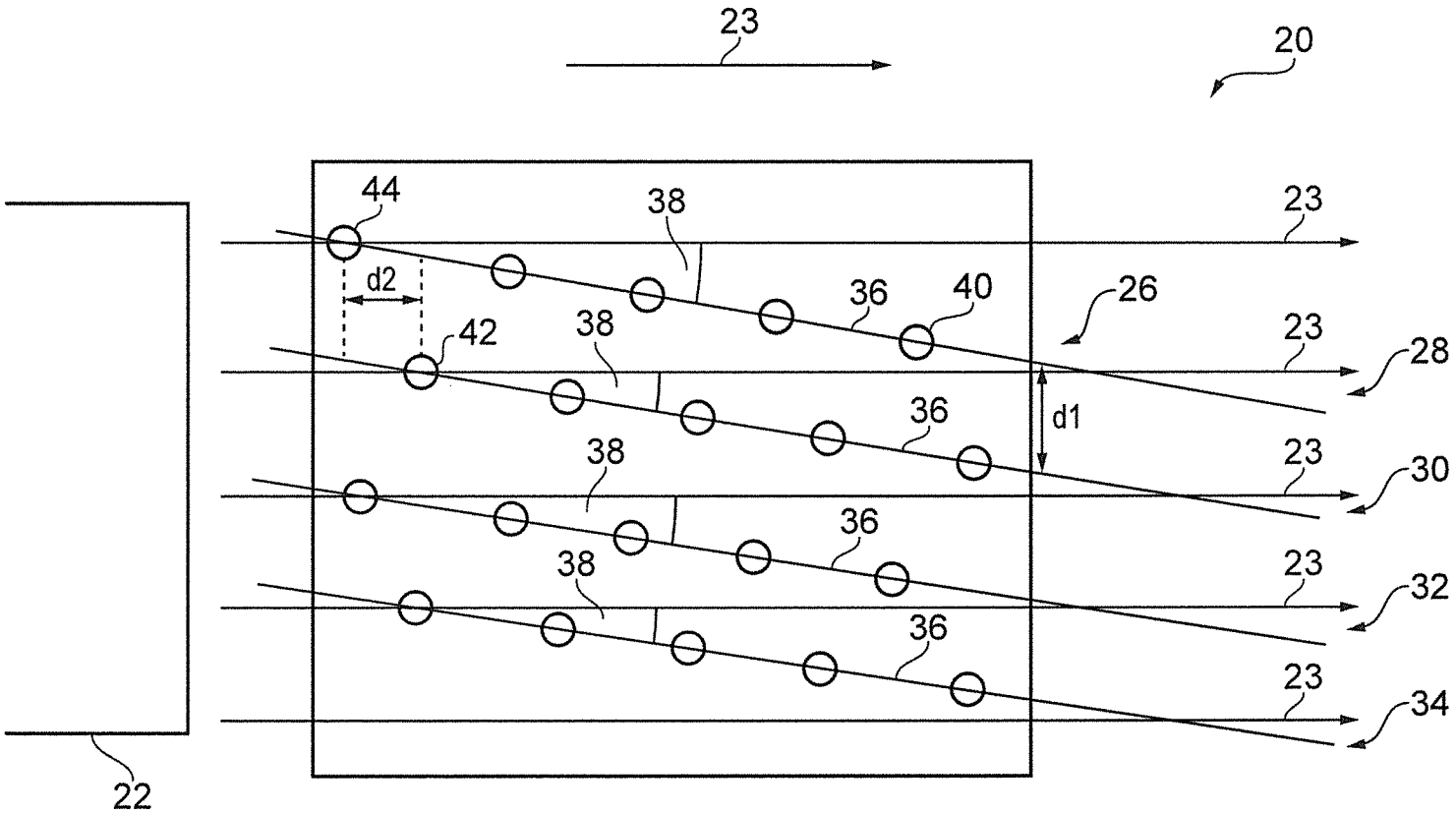
FIG. 2 illustrates a plan view of an impinging plate according to an example.

FIG. 2 illustrates a plan view of an impinging plate 20 (which may also be referred to as a dryer) according to an example. FIG. 2 also illustrates media 22 having a direction of motion indicated by arrows 23.

The impinging plate 20 is planar, has a rectangular shape and defines an array of orifices 26 (which may also be referred to as an array of apertures). In other examples, the impinging plate 20 may have a different shape (the impinging plate 20 may be square or circular for example) and be non-planar (the impinging plate 20 may be a roller for example).

The array of orifices 26 are coupled to the air movement device 18 and are arranged to provide air there through to the media 22. The conveyor 16 (illustrated in FIG. 1) moves the media 22 in the direction of motion 23 (which may also be referred to as the media advance direction) and under the array of orifices 26. The air provided by the array of orifices 26 impinges on the media 22 and dries or cures liquid on the media 22.

The array of orifices 26 includes a plurality of rows of orifices which are arranged oblique to the direction of motion 23 of the media 22. In this example, the array of orifices 26 includes a first row 28, a second row 30, a third row 32 and a fourth row 34, each having orifices that are arranged in straight lines 36. The plurality of rows of orifices 28, 30, 32, 34 may be arranged to provide all portions of the media 22 with air for the same amount of time when a substrate is advanced under the orifices at a constant speed.

The orifices in the array of orifices 26 may have any suitable diameter. In one example the diameter may be 1.20 mm. The direction of motion 23 and the straight lines 36 define oblique angles 38 there between. For example, the oblique angles 38 may have, in one example, an angle in the range of 1.65 degrees to 28.8 degrees.

The array of orifices 26 is arranged so that alternate rows are offset perpendicular to the direction of motion of the media by a predetermined distance. For example, the first row 28 is offset from the second row 30 by a predetermined distance d1. Additionally, the orifices in a row of orifices are positioned a predetermined distance away from one another.

The array of orifices 26 may also be arranged so that an end orifice of a row is positioned adjacent to (but not aligned with) a first orifice of a subsequent row when viewed along the direction of motion 23. For example, the end orifice 40 of the first row 28 is positioned adjacent to the first orifice 42 of the second row 30 when viewed along the direction of motion 23. Consequently, there may be no redundant orifices since there is no overlap between the orifices of a row and a subsequent row when viewed along the direction of motion 23 of the media 22. This may advantageously provide airflow over the media 22 that has homogenous energy distribution.

Additionally, the array of orifices 26 is arranged so that orifices in a row are offset from orifices in a subsequent row in the direction of motion 23 of the media 22. For example, the first orifice 44 of the first row 28 is offset from the first orifice 42 of the second row 30 in the direction of motion 23 of the media 22 by a distance $d_2$. The distance $d_2$ may be selected so that it is different to the various advance distances of the apparatus 10. For example, where the apparatus 10 has a first mode where the media 22 is advanced in 5 mm steps and a second mode where the media 22 is advanced in 7 mm steps, the selected distance for distance $d_2$ may be 6 mm.

The orifices of every other row of orifices are aligned with one another in a direction perpendicular to the direction of motion 23 of the media 23. For example, the orifices of the first row 28 and the third row 32 are aligned with one another in the direction perpendicular to the direction of motion 23 of the media 22, and the orifices of the second row 30 and the fourth row 34 are aligned with one another in direction perpendicular to the direction of motion 23 of the media 22.

The impinging plate 20 is advantageous in that the array of orifices 26 may provide an evenly distributed airflow over the surface of the media 22 and result in the media 22 having a relatively high print quality. The media 22 may have a seamless dried area in which there are no over-cured portions with significant lower gloss performance, or have partially cured areas in which the durability of the liquid is not at a desired level. For example, the impinging plate 20 may provide the media 22 with relatively high color uniformity since black optical density of liquid on the media 22 may be affected by exposure to hot air. By way of another example, the impinging plate 20 may provide the media 22 with relatively high brightness uniformity since the brightness of a liquid on the media 22 is reduced by hot air.

Additionally, the evenly distributed airflow provided by the impinging plate 20 may advantageously reduce deformation of the media 22 caused by the air from the impinging plate 20. For example, where the media 22 comprises polyvinyl chloride, the media 22 may significantly deform where the temperature of the air provided by the impinging plate 20 is in the range of 70 to 125 Celsius. The evenly distributed airflow provided by the impinging plate 20 reduces deformation because each portion of the media 22 is heated similarly. Consequently, the impinging plate 20 may advantageously be used with a relatively large variety of media types.

Furthermore, the impinging plate 20 may reduce the power consumption of the apparatus 10 since the array of orifices 26 may have no redundant orifices, or multiple orifices that provide air to the same portion of the media 22.

The apparatus 10 may be safer in operation than a radiant heating mechanism. The temperature at which the impinging plate 20 operates is usually below the ignition point of the media. For example, the ignition point of some cellulosic media is two hundred and fifty Celsius and the operating temperature of the impinging plate 20 may be less than two hundred and fifty Celsius. Due to the relative safety of the apparatus 10, the apparatus 10 may be run unattended for longer periods of time.

The apparatus 10 may have a higher rate of throughput than apparatus incorporating a radiant heating mechanism. In one comparison with an apparatus incorporating a radiant heating mechanism, the apparatus 10 had a sixty percent higher throughput and used 44% less power.

The apparatus 10 may also have a relatively small footprint (for example, in comparison with an apparatus incorporating a radiant heating mechanism). Where the apparatus 10 is incorporated in a printing system, this may advantageously reduce the size of the printer.

Figure 3:
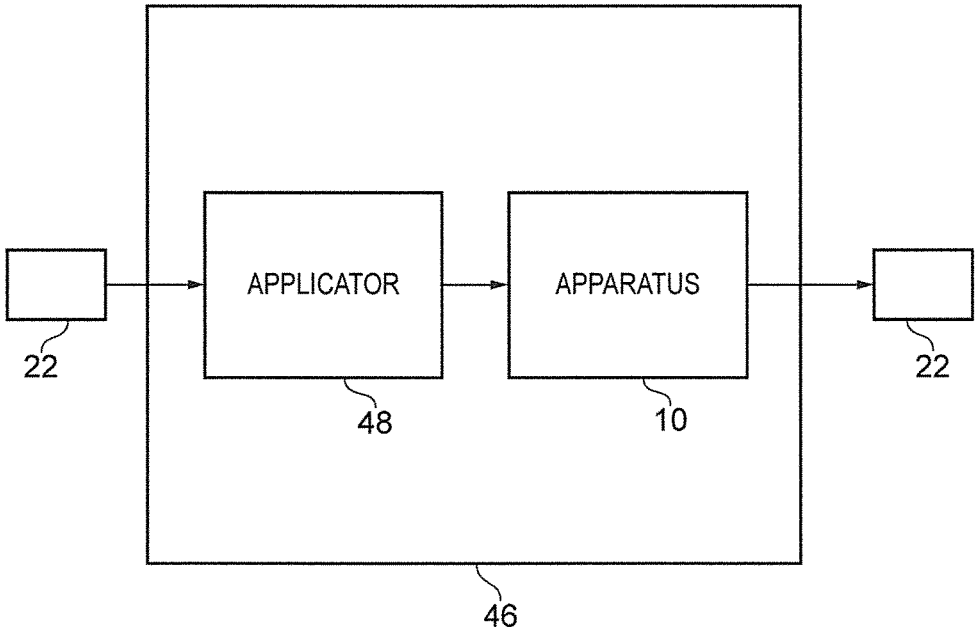
FIG. 3 illustrates a schematic diagram of a system including an apparatus to direct air to media according to an example.

FIG. 3 illustrates a schematic diagram of a system 46 including the apparatus 10 described in the preceding paragraphs and an applicator 48. The system 46 may be a unitary device where the apparatus 10 and the applicator 48 are contained within a single housing. In other examples, the system 46 may not be unitary system and the apparatus 10 and the applicator 48 may be separate devices having separate housings.

The applicator 48 is arranged to receive media 22 and apply liquid to the media 22. The media 22 is subsequently provided to the apparatus 10. The applicator 48 may be any suitable device for apply liquid to the media 22. For example, the applicator 48 may be a priming unit and the liquid may comprise a primer. Alternatively, the applicator 48 may be a printer and the liquid may comprise ink. By way of another example, the applicator 48 may be a post printing treatment unit and the liquid may comprise varnish.

The apparatus 10 is arranged to receive the media 22 from the applicator 48 and provide air to the media 22 to dry or cure the liquid on the media 22. After the media 22 has passed through the apparatus 10, the media 22 may be moved to a tray for collection by a user. Alternatively, the apparatus 10 may provide the media 22 to another device for further treatment.

Figure 4:
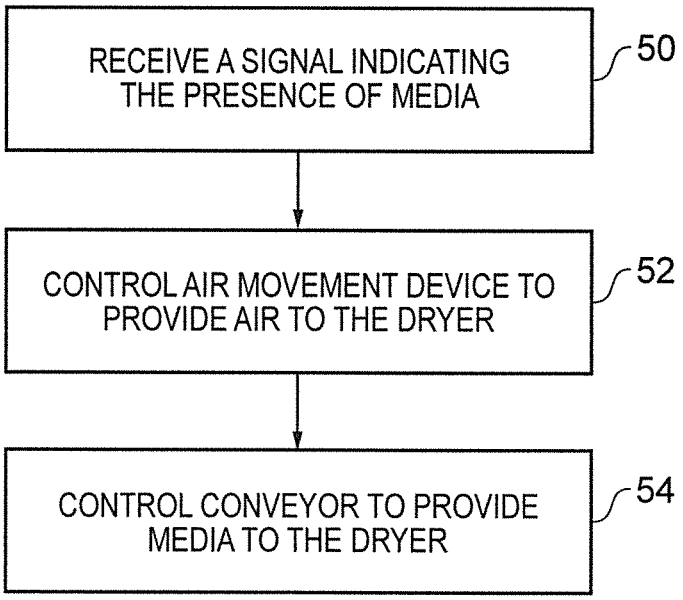
FIG. 4 illustrates a flow diagram of a method according to an example.

FIG. 4 illustrates a flow diagram of a method of operating the apparatus 10 according to an example.

At block 50, the method includes receiving a signal indicating the presence of media 22. For example, the controller 12 may receive a signal from the detector 14 that indicates the presence of media 22 at the apparatus 10. By way of another example, the controller 12 may receive a signal from the applicator 48 in response to the applicator 48 having completed applying liquid to the media 22. Alternatively, the controller 12 may receive a signal from a user input device.

At block 52, the method includes controlling the air movement device 18 to provide air 24 to the impinging plate/dryer 20. Block 52 may also include controlling the heater 19 to heat the air 24. Block 52 may be performed in response to the signal received in block 50.

At block 54, the method includes controlling the conveyor 16 to provide the media 22 to the impinging plate/dryer 20 and move the media 22 there through. Block 54 may be performed in response to the signal received in block 50. Additionally, block 54 may be initiated at the same time as block 52, or may be initiated prior to block 52.

The blocks illustrated in the FIG. 4 may represent steps in a method and/or sections of code in the computer program 28. The illustration of a particular order to the blocks does not necessarily imply that there is a required or preferred order for the blocks and the order and arrangement of the block may be varied. Furthermore, it may be possible for some blocks to be omitted.

Although examples of the present invention have been described in the preceding paragraphs, it should be appreciated that modifications to the examples given can be made without departing from the scope of the invention as claimed. For example, the impinging plate/dryer 20 is not limited to the structure illustrated in FIG. 2 and may have any number of rows of orifices and may have any number of orifices in a row.

Figure 5:
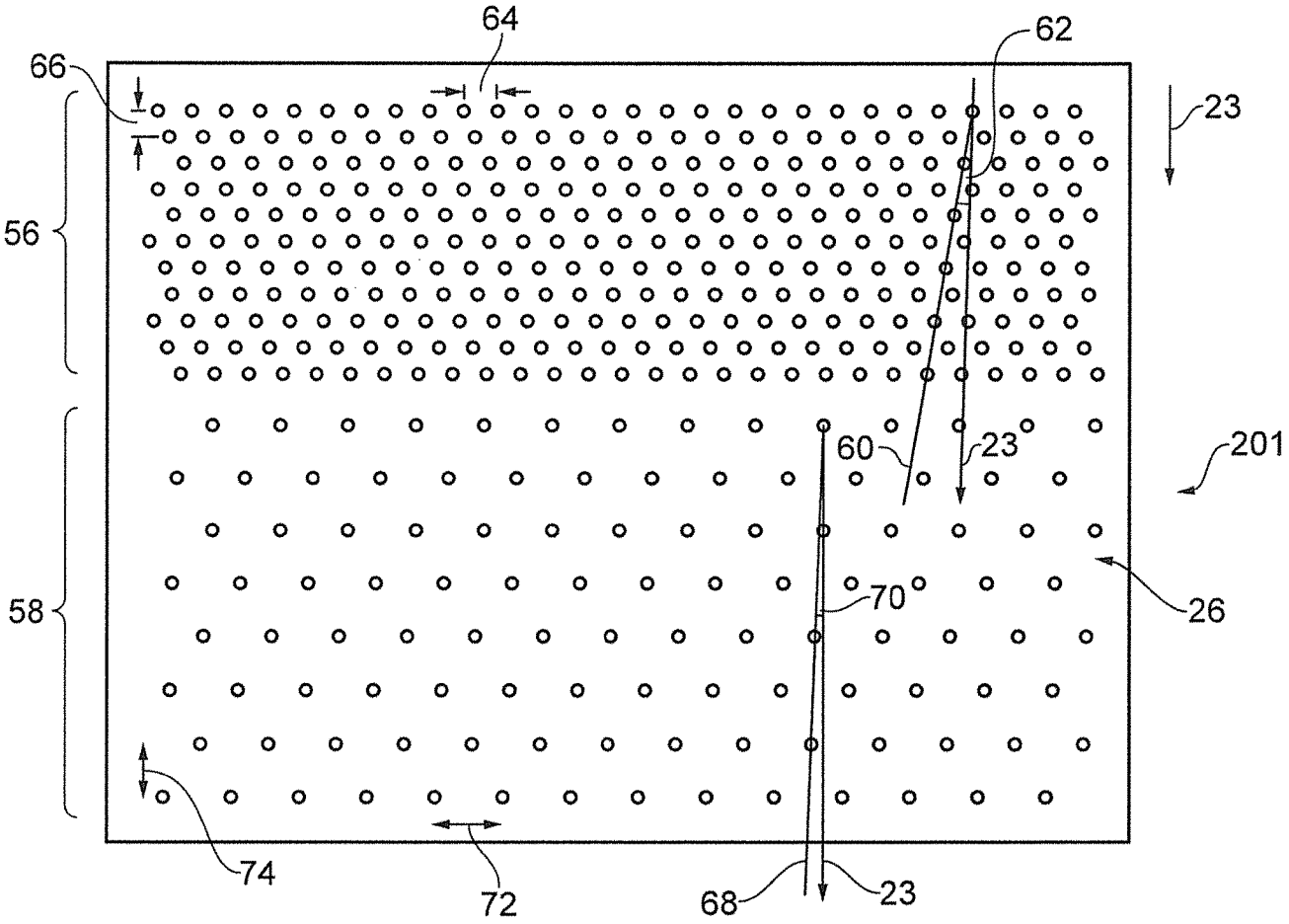
FIG. 5 illustrates a plan view of another impinging plate according to an example.

FIG. 5 illustrates a plan view diagram of another impinging plate 201 according to an example. The impinging plate 201 is similar to the impinging plate 20 illustrated in FIG. 2 and where the features are similar, the same reference numerals are used. The impinging plate 201 may be used in the apparatus 10 as a replacement to the impinging plate 20.

The impinging plate 201 differs from the impinging plate 20 in that the array of orifices 26 includes a first subset 56 of orifices and a second subset 58 of orifices. The first subset 56 is positioned prior to the second subset 58 in the direction of motion 23 of the media. The first subset 56 and the second subset 58 differ from one another in that they have different spaces between the orifices. Furthermore, the first and second subsets 56, 58 differ in that the oblique angles of the rows of orifices are different in the different subsets.

The first subset 56 includes a plurality of rows of orifices that are arranged in straight lines. For example, row 60 includes a plurality of orifices that are arranged in a straight line and are arranged at an oblique angle 62 relative to the direction of motion 23 of media.

The rows in the first subset 56 are arranged so that orifices that are adjacent one another in the direction perpendicular to the direction of motion 23 are spaced 3.50 mm apart from one another (indicated by the arrows with reference numeral 64).

The rows in the first subset 56 are also arranged so that orifices in a row are offset from orifices in a subsequent row in the direction of motion 23 of the media 22. In this example, the orifices in a row are offset from orifices in a subsequent row in the direction of motion 23 by a distance of 3.03 mm (indicated by the arrows with reference numeral 66).

The second subset 58 also includes a plurality of rows of orifices that are arranged in straight lines. For example, row 68 includes a plurality of orifices that are arranged in a straight line and are arranged at an oblique angle 70 relative to the direction of motion 23 of media. The oblique angle 70 is different to the oblique angle 62 of the first subset 56.

The rows in the second subset 58 are arranged so that orifices that are adjacent one another in the direction perpendicular to the direction of motion 23 are spaced 7.00 mm apart from one another (indicated by the arrow with reference numeral 72).

The rows in the second subset 58 are also arranged so that orifices in a row are offset from orifices in a subsequent row in the direction of motion 23 of the media 22. In this example, the orifices in a row are offset from orifices in a subsequent row in the direction of motion 23 by a distance of 6.06 mm (indicated by the arrow with reference numeral 74).

The impinging plate 201 may be advantageous in that the first subset 56 (which includes relatively closely packed orifices) first provides air to media and then the second subset 58 (which includes relatively less packed orifices) provides air to the media. This arrangement of orifices may reduce or eliminate the number of marks in the ink on the media caused by air from the impinging plate.

In other examples, the plurality of rows of orifices may be arranged so that orifices that are adjacent to one another in the direction perpendicular to the direction of motion 23 may be spaced apart from one another by any suitable distance. For example, adjacent orifices may have any spacing in the range of 3.50 mm to 7.00 mm. Additionally, the plurality of rows may be arranged so that orifices in a row are offset from orifices in a subsequent row in the direction of motion 23 of the media 22 by any suitable distance. For example, the offset distance may have any value in the range of 3.03 mm to 6.06 mm.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An apparatus in a printing system to direct air to media, the apparatus comprising:

an impinging plate having a first subset of orifices and a second subset of orifices, the orifices of the first subset being arranged in a plurality of rows at a first oblique angle relative to a direction of motion of the media, the orifices of the second subset being arranged in a plurality of rows at a second oblique angle relative to the direction of motion of the media, wherein:

the first oblique angle of the first subset is different from the second oblique angle of the second subset;

orifices in a row are offset from orifices in a subsequent row in the direction of motion of the media; and orifices of every other row in the first subset are aligned with one another in a direction perpendicular to the direction of motion of the media;

an air movement device to provide air; and a heater positioned between the air movement device and the impinging plate, wherein the heater is to heat the air provided by the air movement device and provide the heated air to the impinging plate, wherein the heated air flows through the orifices of the impinging plate onto the media.

2. The apparatus of claim 1, wherein the orifices of at least one row are arranged in a straight line.

3. The apparatus of claim 1, wherein the orifices in the first subset have a denser arrangement than the orifices in the second subset, and wherein the first subset of orifices is positioned prior to the second subset of orifices in the direction of motion of the media.

4. The apparatus of claim/herein alternate rows of the orifices in the first subset are offset perpendicular to the direction of motion of the media by a predetermined distance.

5. The apparatus of claim 1, wherein the plurality of rows of orifices are arranged to provide all portions of the media with air for a same amount of time.

6. The apparatus of claim 1, wherein the impinging plate is planar.

7. The apparatus of claim/herein the orifices of the first subset have a same size as the orifices of the second subset.

8. The apparatus of claim 1, further comprising a controller to control an operation of the air movement device.

9. The apparatus of claim 8, further comprising:

a detector to detect a presence of the media, and wherein the controller is to control the operation of the air movement device in response to a signal from the detector.

10. The apparatus of claim 1, wherein the impinging plate is a roller.

11. The apparatus of claim 1, wherein a spacing between orifices in the first subset that are adjacent one another in a direction perpendicular to the direction of motion of the media is larger than an offset between adjacent rows in the first subset in the direction of motion of media.

12. A printing system comprising:

an impinging plate having a first subset of orifices and a second subset of orifices, the orifices of the first subset being arranged at a first oblique angle relative to a direction of motion of media, the orifices of the second subset being arranged at a second oblique angle relative to the direction of motion of the media, wherein:

the first oblique angle of the first subset is different from the second oblique angle of the second subset;

orifices in a row are offset from orifices in a subsequent row in the direction of motion of the media; and orifices of every other row in the first subset are aligned with one another in a direction perpendicular to the direction of motion of the media;

an air movement device;

a heater positioned between the air movement device and the impinging plate; and a controller including a processor and a computer readable medium storing instructions that when executed by the processor cause the processor to:

control the air movement device to provide air, and control the heater to heat the air provided by the air movement device and to provide the heated air to the impinging plate, wherein when the media moves in the direction of motion, the air provided by the air movement device is heated by the heater and flows through the first and second subsets of orifices of the impinging plate onto the media.

13. The printing system of claim 12, further comprising: an applicator to apply liquid to the media, wherein the applicator is a priming unit and the liquid comprises a primer.

14. The printing system of claim 13, wherein the impinging plate is circular.

15. The printing system of claim 13, wherein the applicator is a post printing treatment unit and the liquid comprises varnish.

16. A method of controlling a dryer in a printing system, the method comprising:

providing a dryer having a first subset of apertures and a second subset of apertures, the apertures of the first subset being arranged at a first oblique angle relative to a direction of motion of media, the apertures of the second subset being arranged at a second oblique angle relative to the direction of motion of the media, wherein:

the first oblique angle of the first subset is different from the second oblique angle of the second subset;

orifices in a row are offset from orifices in a subsequent row in the direction of motion of the media; and orifices of every other row in the first subset are aligned with one another in a direction perpendicular to the direction of motion of the media;

controlling, by a hardware controller, an air movement device to provide air towards the dryer; and controlling, by the hardware controller, a heater to heat the air provided by the air movement device and provide the heated air to the dryer, wherein the heater is positioned between the air movement device and the dryer such that, when the media moves in the direction of motion, the air provided by the air movement device is heated by the heater and flows through the first and second subsets of apertures of the dryer onto the media.

17. The method of claim 16, further comprising:

receiving a signal from a detector indicating a presence of media;

controlling the operation of the air movement device in response to the signal from the detector indicating the presence of the media; and controlling the operation of the heater n response to the signal from the detector indicating the presence of the media.

18. The method of claim 16, wherein the apertures of the first subset having a same size as the apertures of the second subset.

19. The method of claim 16, wherein the apertures in the first subset have a denser arrangement than the apertures in the second subset, wherein the first subset of apertures is positioned prior to the second subset of apertures in the direction of motion of the media.

* * * * *